US009765474B1

(12) United States Patent
Bergman

(10) Patent No.: US 9,765,474 B1
(45) Date of Patent: Sep. 19, 2017

(54) STEAMER SYSTEM AND METHOD OF USE

(71) Applicant: Jennifer Jean Bergman, Plano, TX (US)

(72) Inventor: Jennifer Jean Bergman, Plano, TX (US)

( * ) Notice: Subject to any disclaimer, the term of this patent is extended or adjusted under 35 U.S.C. 154(b) by 0 days.

(21) Appl. No.: 15/267,235

(22) Filed: Sep. 16, 2016

Related U.S. Application Data

(60) Provisional application No. 62/311,208, filed on Mar. 21, 2016.

(51) Int. Cl.
*D06F 73/00* (2006.01)
*F22B 1/28* (2006.01)

(52) U.S. Cl.
CPC ..... *D06F 73/00* (2013.01); *F22B 1/284* (2013.01)

(58) Field of Classification Search
None
See application file for complete search history.

(56) References Cited

U.S. PATENT DOCUMENTS 4,199,088 A * 4/1980 Sanko ..... D06F 73/00 223/67

* cited by examiner

*Primary Examiner* — Michael Barr
*Assistant Examiner* — Jason Riggleman
(74) *Attorney, Agent, or Firm* — Richard G. Eldredge; Eldredge Law Firm

(57) ABSTRACT

A clothing steamer system includes a body having an inner cavity; a first steamer arm slidingly engaged to the body; a second steamer arm slidingly engage to the body, the second steamer arm being configured to move in a direction opposite to a direction of the first steamer arm; a steamer disposed within the body and in gaseous communication with the first steamer arm and the second steamer arm; and a fluid reservoir disposed within the body and in fluid communication with the steamer.

8 Claims, 8 Drawing Sheets

STEAMER SYSTEM AND METHOD OF USE

BACKGROUND

1. Field of the Invention

The present invention relates generally to steamers, and more specifically to steamer system for clothing articles.

2. Description of Related Art

Clothes steamers are well known in the art and are effective means to clean and remove wrinkles from clothing. In FIG. 1, and exemplary conventional steamer 101 is shown having a nozzle 103 configured to direct steam 105 in a direction towards a shirt 100 for removing wrinkles and/or for cleaning. The steamer 101 includes a housing 107 within an inner cavity configured to carry a steam generator 113 in fluid communication with a reservoir 111. During use, the generator 113 creates steam, which in turn is channeled to nozzle 103 via a hose 115 in gaseous communication with the inner cavity of housing 107.

Although effective in most applications, the steamer 101 has limitations. For example, the process is arduous and time consuming. The user is required to manipulate the shirt 100 and orient the nozzle at various orientations and locations to adequately remove the shirt wrinkles. The process is further limited by having a bulky body 107 that the user is required to haul around to perform the steaming operation.

Although great strides have been made in the area of steamers, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
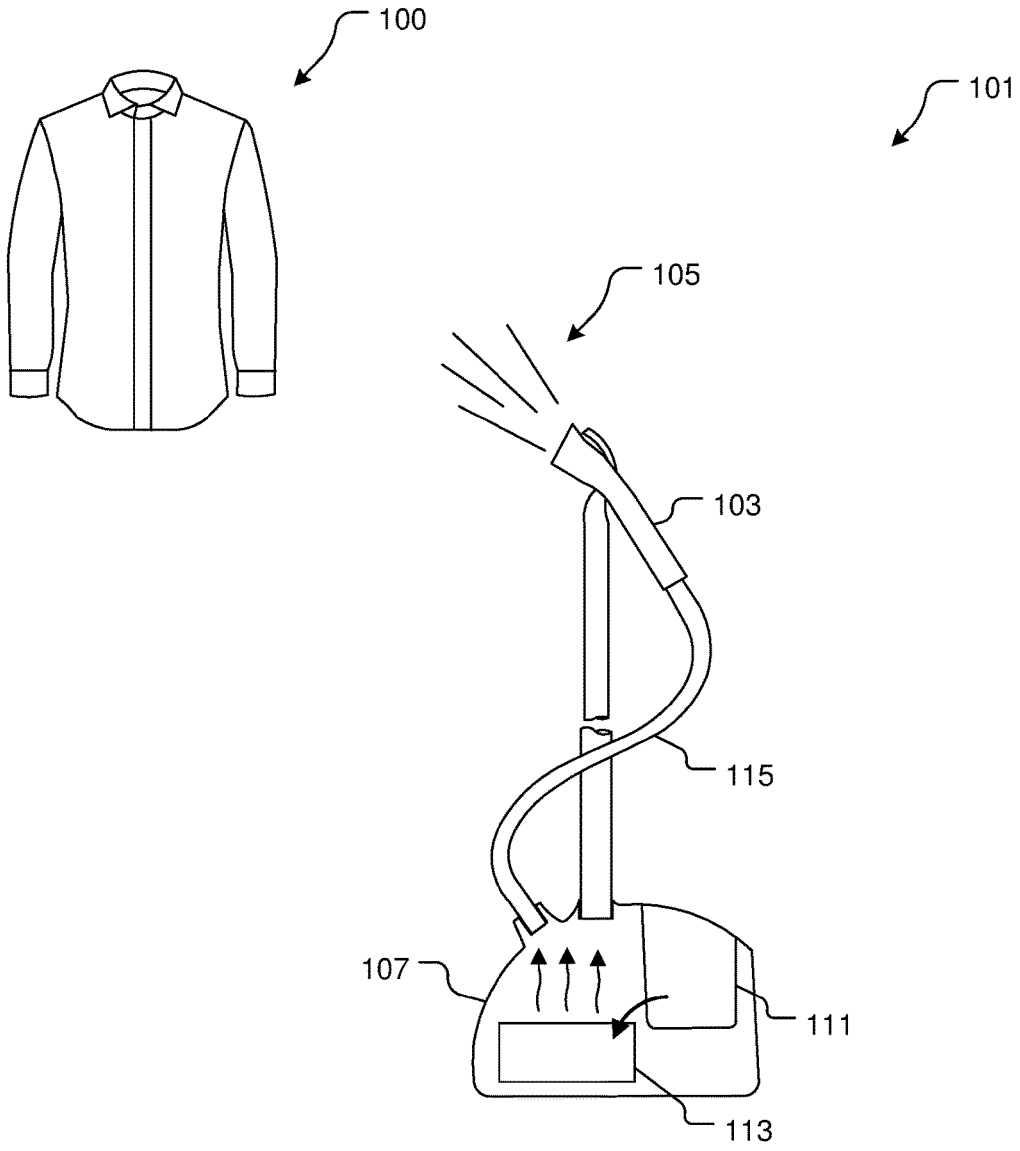
FIG. 1 (Prior Art)
FIG. 1 is a simplified schematic of a conventional steamer.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2B:
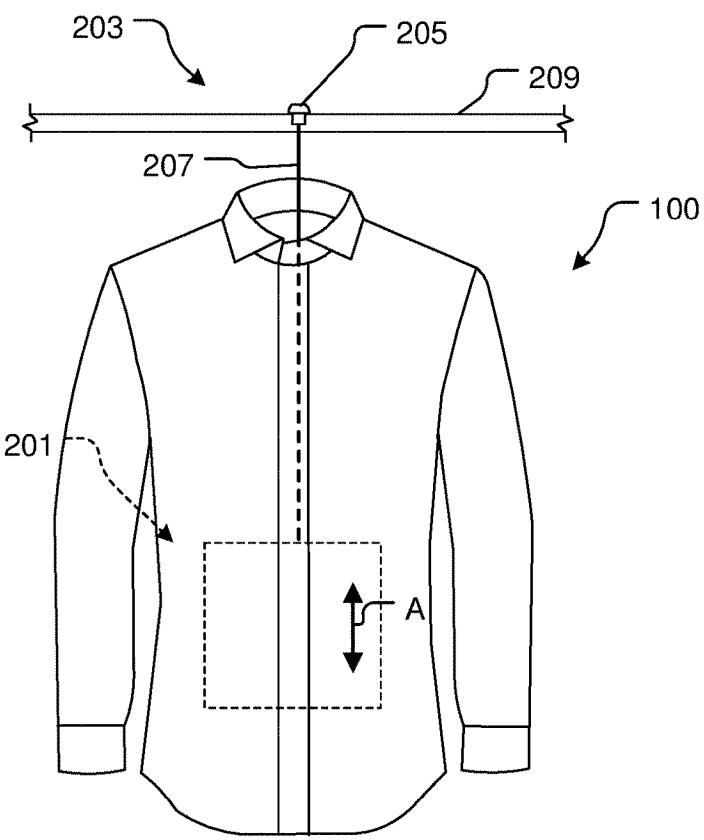
FIGS. 2A and 2B is a front view of a steamer system in accordance with one embodiment of the present application during operation.
Figure 2A:
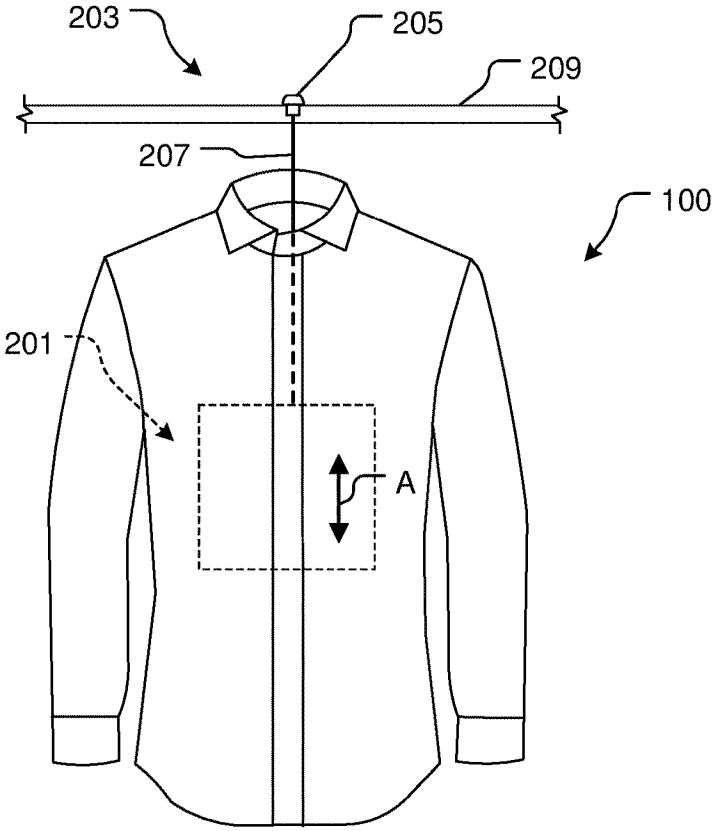

Referring now to the drawings wherein like reference characters identify corresponding or similar elements throughout the several views, FIGS. 2A and 2B depict front views of a steamer system 201 during use with shirt 100. It will be appreciated that the system 201 overcomes one or more of the above-listed problems commonly associated with the conventional steamer systems and methods of use.

In the contemplated embodiment, system 201 includes a lift device 203 having an anchor 205 configured to secure to a structure 209 and a cable 207 attached thereto. During operation, the lift device is configured to elevate the housing of system 201 in direction A, as indicated by an arrow. In the exemplary embodiment, the housing of system 201 is shown disposed within an inner area of the shirt 100. Accordingly, it is preferred that stream generated from the system is directed to the inner area of the shirt.

Figure 3B:
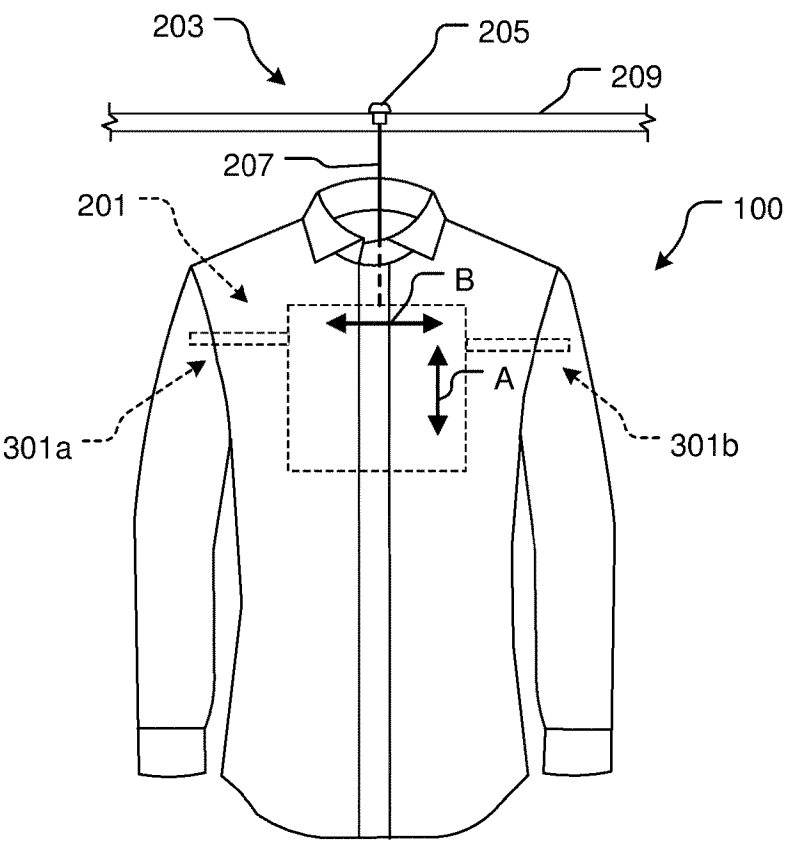
FIGS. 3A and 3B are front views of the steamer of FIG. 2A.
Figure 3A:
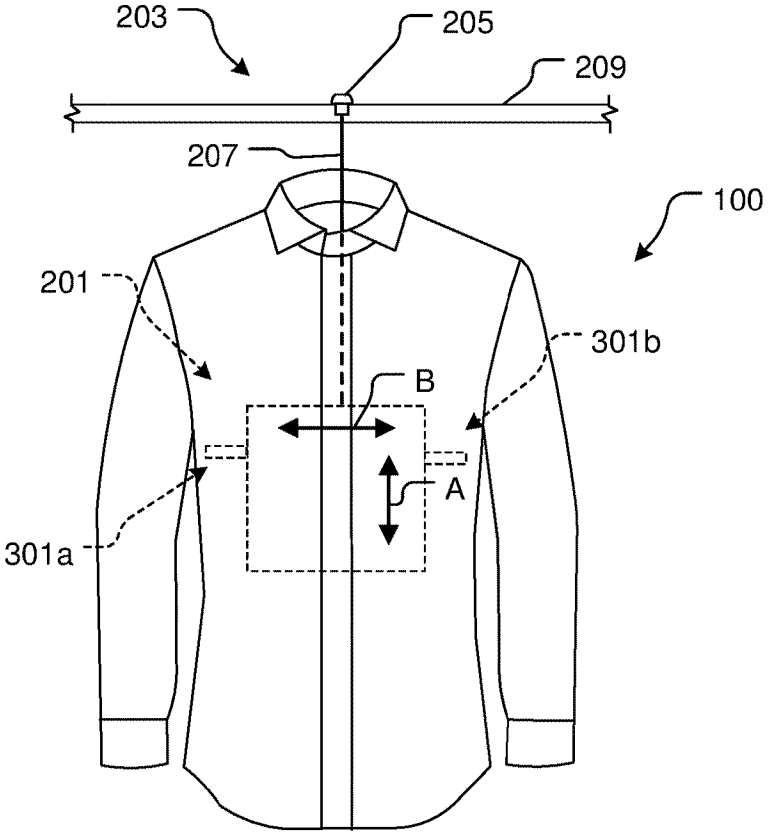

In FIGS. 3A and 3B, system 201 also include an arm device having two arms 301*a*, 301*b* that move within and out of the housing as indicated by arrow B. This feature allows further reach of one or more nozzles within the inner area of the shirt 100.

Figure 4:
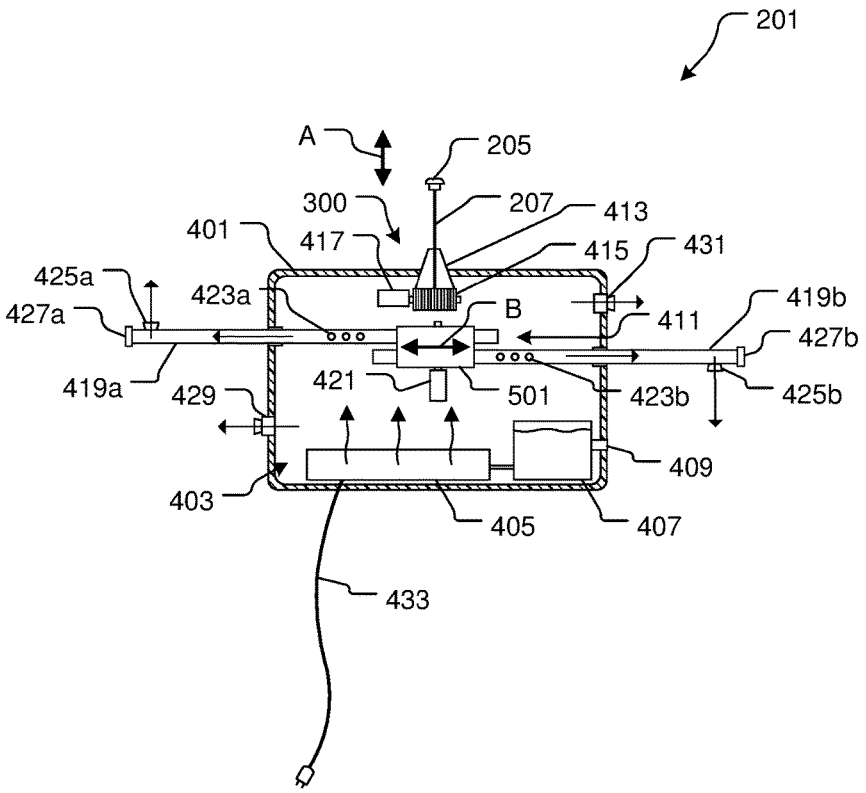
FIG. 4 is a cross-sectional side view of the steamer of FIG. 2A.

Referring now to FIG. 4, the system 201 is shown in detail. System includes a housing 401 that forms an inner cavity 403. Disposed within the cavity 403 is a steam generator 405 in fluid communication with a fluid reservoir 407. During use, a port 409 and/or similar means allows communication with the fluid reservoir 407 and can be utilized to fill the reservoir with water, which in turn is channeled to the steam generator 405.

Figure 5A:
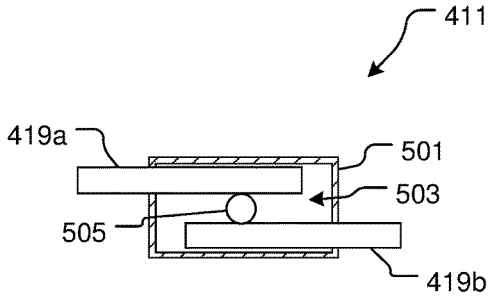
FIGS. 5A and 5B are front cross-sectional views of the arm device of the steamer of FIG. 3A.
Figure 5B:
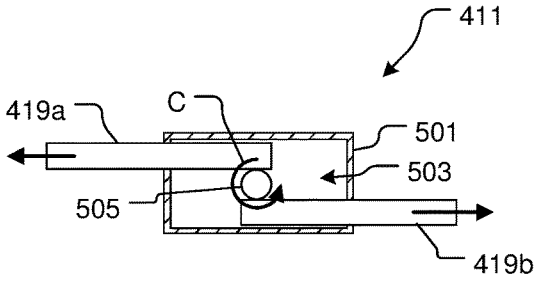

As indicated by arrows, it is contemplated having the steam created by the steam generator 405 to fill cavity 403, which in turn travel through hollow arms 419*a*, 419*b* of arm device 411 via respective holes 423*a*, 423*b*. Thereafter, the steam exits the hollow arms 419*a*, 419*b* via respective nozzles 425*a*, 425*b*. The adjustment of the arms 419*a*, 419*b* relative to the housing 401 is achieved via a motor 421 rotatably attached to the arms 419*a*, 419*b* via a wheel drive 505 disposed within an inner cavity 503 of housing 501 (see, e.g., FIGS. 5A and 5B). The rotational movement, as indicated by arrow C, of the wheel drive 505 causes the arms 419*a*, 419*b* to move in direction B. Although shown with a motor and associated drive wheel, it will be appreciated that other embodiments could include other types of drive systems for moving the arms in direction B.

System 201 is provided with a lift device 300 configured to elevate the housing and associated components of system 201 in direction A. To achieve this feature, the lift system 300 includes a motor 417 rigidly attached to a spool 415 of wound cable 207. The cable 413 extends through the thickness of housing 401 via a cone 413.

The system 201 is also provided with a plurality of nozzles extending through the thickness of housing 401 an in fluid communication with cavity 403. For example, two exemplary nozzles 429, 431 are shown to illustrate these features. The placement of the nozzles could be any surface of the housing and should not be limited to the placement shown in the exemplary embodiment.

One of the unique features also believed characteristic of the present steamer system is one or more optional sensors 427*a*, 427*b* on the ends of respective arms 419*a*, 419*b*. In the contemplated embodiment, the sensors are configured to determine the location of the inner surface of the inner area of the shirt 100. This feature enables the arms to extend to a location proximate to the inner surface for exertion of the steam via the steam nozzles.

The components of system 201 are powered via a power cord 433 conductively coupled to the generator 405, lift device 300, and arm device 411. However, it is also contemplated utilizing a portable power source in lieu of the preferred embodiment. For example, a battery pack could be used in lieu of the preferred cord 433.

Referring now to FIGS. 6A-12B in the drawings, various views of an alternative steamer system 601 are shown. It will be appreciated that system 601 is similar in function to system 201 discussed above and incorporates one or more of the features discussed herein, and vice-versa.

Figure 6A:
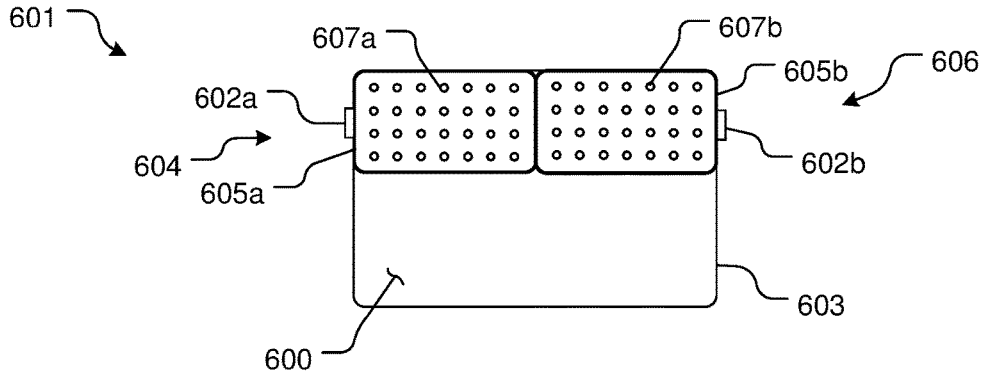
FIGS. 6A, 6B, and 6C are front views of a steamer system in accordance with one embodiment of the present application.
Figure 6B:
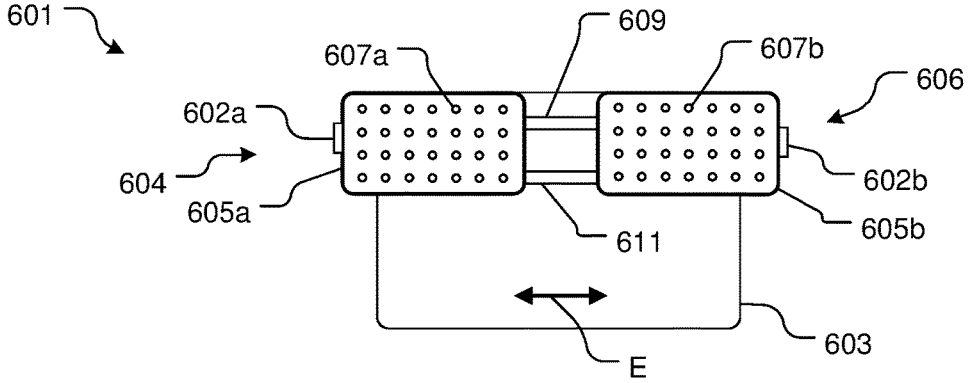
Figure 6C:
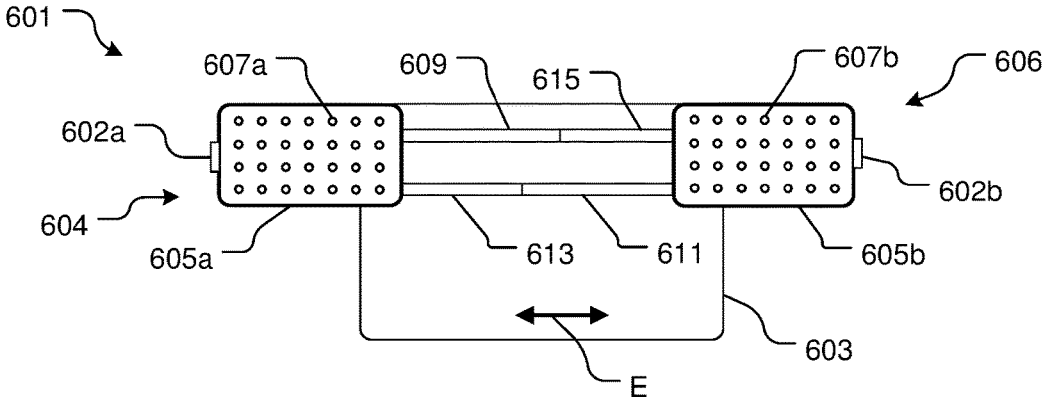
Figure 11:
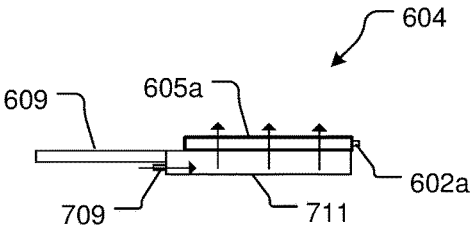
FIG. 11 is a top view of the steamer art of FIG. 8 during use.
Figure 12A:
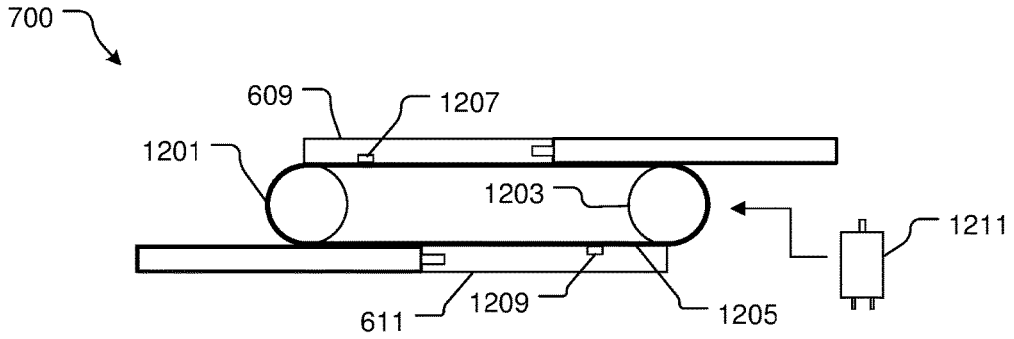
FIGS. 12A and 12B are front views of the arm drive assembly of the system of FIG. 7.
Figure 12B:
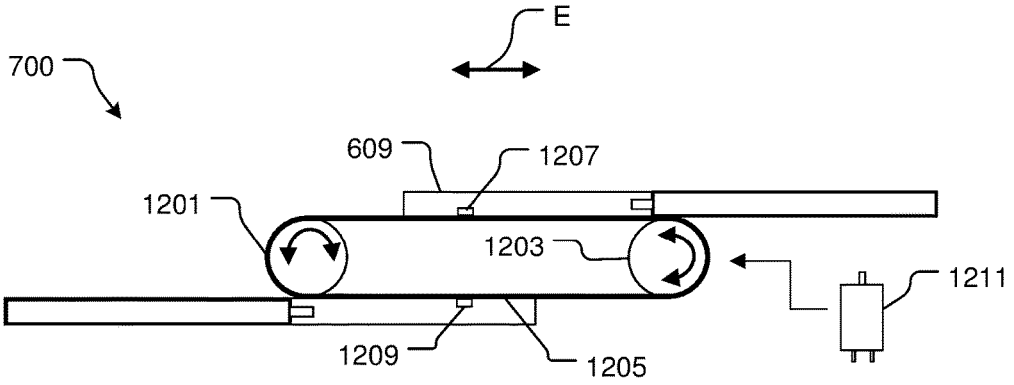

System 601 includes a body 603 that forms an internal cavity 701 and configured to carry two steamer arms 604, 606 configured to move in a direction away from each other, as depicted with arrow E in FIGS. 6B, 6C. The first steamer arm 604 includes a perforated body 605*a* forming an inner cavity and having a plurality of ports 607*a* extending through the thickness of the body 605*a* and in fluid communication with the inner cavity. During use, the steam generated by steam generator 703 passes through body 605*a* and through ports 607*a* as depicted in FIG. 11. Likewise, second arm 606 includes a body 605*b* with a plurality of ports 607*b* similar to arm 604. The arms 604, 606 optionally include respective sensors 602*a*, 602*b* configured to detect the ends of the garment that steam is being applied thereto. As shown in FIGS. 6B and 6C, respective bodies 605*a*, 605*b* are secured to elongated shafts 613, 615 configured to slidingly engage with slots 609, 611. In the preferred embodiment, the slots extend within front surface 600 of body 603.

Figure 7:
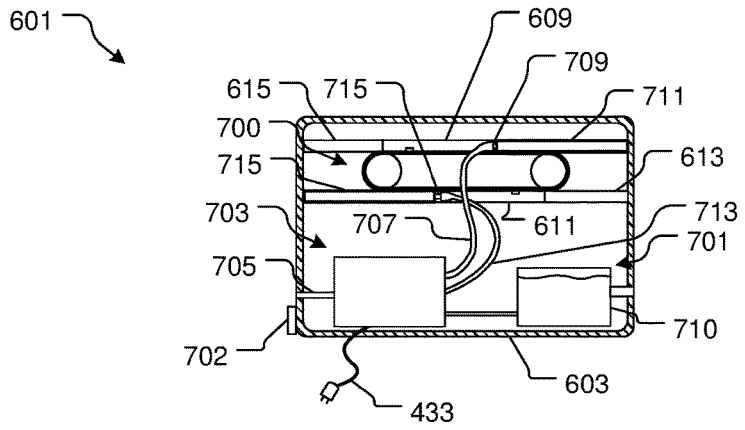
FIG. 7 is a back cross-sectional view of the steamer system of FIG. 6A.
Figure 8:
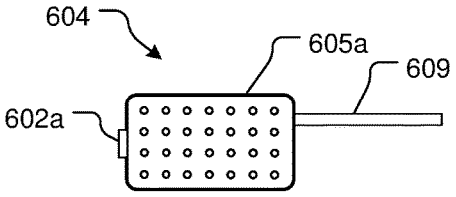
FIG. 8 is a front view of a steamer arm of the system of FIG. 6A.
Figure 9:
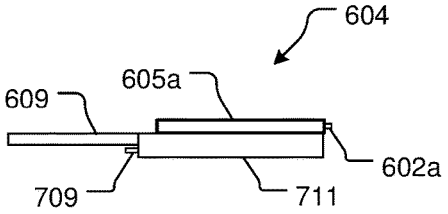
FIG. 9 is a top view of the steamer arm of FIG. 8.
Figure 10:
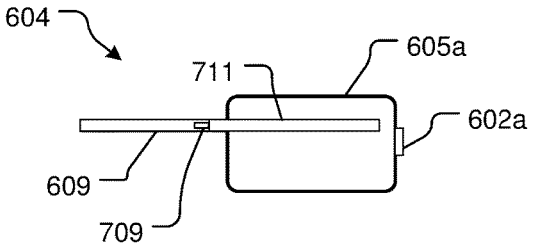
FIG. 10 is a back view of the steamer arm of FIG. 8.

Referring now specifically to FIG. 7, a back cross-sectional view of the system 601 is shown. Disposed within cavity 701 is a steam generator 703 conductively coupled to an external power source via cord 433 and in fluid communication with a port extending through the thickness of the housing wall. In one contemplated embodiment, the steam generator 703 could be in fluid communication with an internal reservoir 710 that provides the necessary fluid to create the steam; however, it will be appreciated that an external water reservoir could also be utilized in an alternative embodiment. The steam generator 703 is in gaseous communication with first arm 604 via a hose 707 that engages with a stem secured to a housing 711. It will be appreciated that housing 711 is in fluid communication with body 605*a*, which in turn is in fluid communication with the plurality of ports 607*a*. Likewise, the steam generator 703 is in gaseous communication with second arm 604 via a second hose 713 secured to a stem 715 of a housing 715 in fluid communication with body 605*a*. The different views of first arm 604 help illustrates the different components of the steamer arm 604.

It will be appreciated that a drive mechanism 700 is disposed within cavity 701 and configured to drive the arms 604, 606 in a direction away from each other. In FIGS. 7A and 7B, drive mechanism 700 is shown having a first pulley 1201, a second pulley 1203, and a drive chain 1205 that engages both pulleys. The drive chain 1205 secures to shaft 609 via a key 1207 and shaft 611 via a key 1209. The keys are configured to engage with and to prevent slipping of the shafts. A drive motor 1211 is utilized to rotate the pulleys, as indicated by an arrow.

Figure 13:
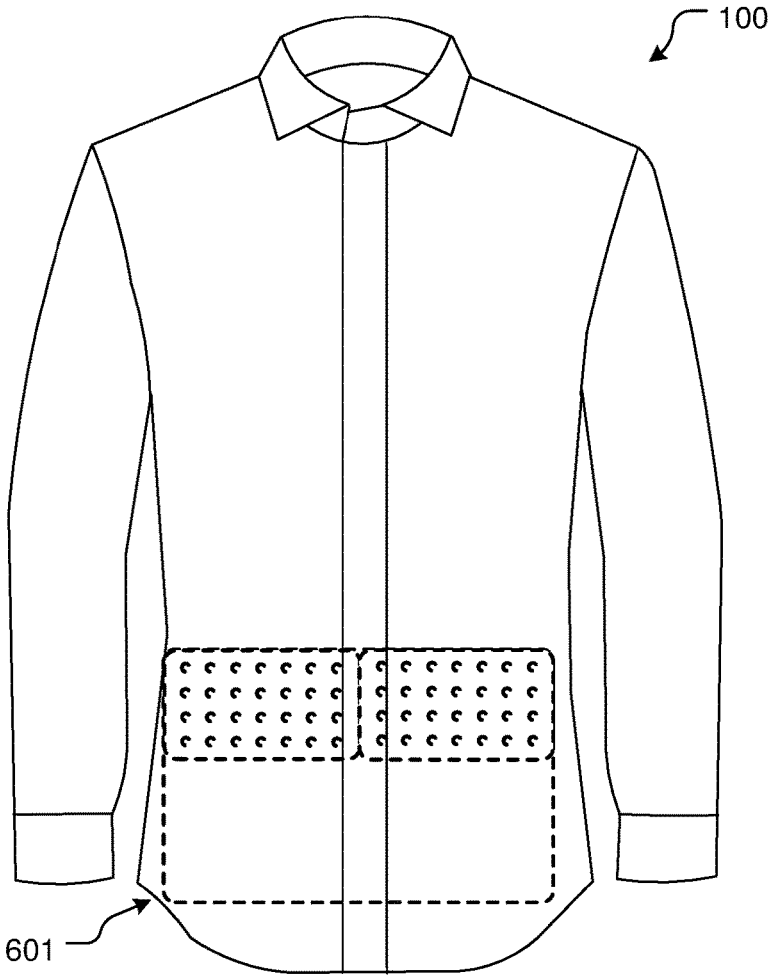
FIG. 13 is a front view of the system of FIG. 6A during use.

In FIG. 13, a front view of the system 601 in phantom lines is shown during use. It will be appreciated that system 601 is preferably used for the outer surfaces of the article of clothing 100 and/or other objects discussed herein. Accordingly, the steam created by the steam generator is directed through the nozzles to an outer surface of the article of clothing and is not positioned within the clothing itself.

It will be appreciated that the system 601 could incorporate a lift system discussed above to elevate the system at a height relative to the ground surface. System 601 could optionally be provided with a vertical sensor 702 carried by housing 603 and configured to detect the vertical length of the clothing. The sensors discussed herein are utilized to perform an autonomous delivery of the steam to the article of clothing; however, it will be appreciated that a quick-release attachment could be utilized in fluid communication with generator 703 and in communication with a handheld steam nozzle for delivering the steam manually. It will all be appreciated that the system 601 could be disposed within the garment interior or to remain outside the garment.

It should be understood that although the systems discussed herein are utilized with shirts, it will be appreciated that that the system could be utilized with different types of clothing, for example, pants, scarves, dresses, and the like. It will also be appreciated that the systems discussed herein could be utilized with different types of fabrics in lieu of articles of clothing. For example, the system could be used to provide steam to a curtain, table cloth, and the like.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A clothing steamer system, comprising:

a body having an inner cavity;

a first steamer arm slidingly engaged to the body;

a second steamer arm slidingly engage to the body, the second steamer arm being configured to move in a direction opposite to a direction of the first steamer arm;

a steamer disposed within the body and in gaseous communication with the first steamer arm and the second steamer arm; and a fluid reservoir disposed within the body and in fluid communication with the steamer;

wherein fluid from the fluid reservoir passes through the steamer, which turns the fluid to a gas, which in turn passes through the first steamer arm and the second steamer arm; and wherein the first steamer arm and the second steamer arm slide relative to each other relative to the body.

2. The system of claim 1, further comprising:

a lift device secured to the body and configured to secure to a hanging structure and lift the system at a height relative to a ground surface.

3. The system of claim 2, the lift device comprising:

an anchor configured to secure to the hanging structure;

a cable secured to the anchor at a first end; and a spool disposed within the cavity of the body.

4. The system of claim 3, further comprising:

a motor positioned within the cavity of the body and configured to rotate the spool.

5. The system of claim 1, further comprising:

the first steamer arm having:

a fluid sealed body forming a cavity and a plurality of port extending through the thickness of the body and in fluid communication with the cavity; and an elongated shaft rigidly attached to body and configured to slidingly engage within a slot formed by a front surface of the body; and the second steamer arm having:

a fluid sealed body forming a cavity and a plurality of port extending through the thickness of the body and in fluid communication with the cavity; and an elongated shaft rigidly attached to body and configured to slidingly engage within a slot formed by a front surface of the body.

6. The system of claim 5, further comprising:

a first sensor secured to the first fluid sealed body; and a second sensor secured to the second fluid sealed body.

7. The system of claim 5, further comprising:

a drive mechanism carried within the cavity of the body and configured to move the first steamer arm and the second steamer arm relative to each other.

8. The system of claim 7, the drive mechanism comprising:

a first pulley and a second pulley;

a drive chain secured to the first pulley and the second pulley and secured to the first steamer arm and the second steamer arm;

wherein the drive chain moves the first steamer arm and the second steamer arm in a direction opposite to each other.

* * * * *